United States Patent [19]

Nuesslein et al.

[11] Patent Number: 4,776,965

[45] Date of Patent: Oct. 11, 1988

[54] AQUEOUS CONCENTRATED FABRIC SOFTENER

[75] Inventors: Hans Nuesslein, Langenfeld; Theodor Voelkel, Duesseldorf; Rolf Puchta, Haan, all of Fed. Rep. of Germany

[73] Assignee: Henkel Kommanditgesellschaft auf Aktien, Duesseldorf, Fed. Rep. of Germany

[21] Appl. No.: 88,475

[22] Filed: Aug. 19, 1987

Related U.S. Application Data

[63] Continuation of Ser. No. 819,165, Jan. 14, 1986, abandoned.

[30] Foreign Application Priority Data

Jan. 18, 1985 [DE] Fed. Rep. of Germany ..... 3501521

[51] Int. Cl.[4] ..... D06M 9/00

[52] U.S. Cl. ..... 252/8.8; 252/8.6; 252/8.9

[58] Field of Search ..... 252/8.8, 174.21, 142, 252/8.6, 8.9

[56] References Cited

U.S. PATENT DOCUMENTS

| | | | |
|---|---|---|---|
| 3,775,316 | 11/1973 | Fries et al. | 252/8.8 |
| 4,171,278 | 10/1979 | Andre et al. | 252/8.8 |
| 4,291,071 | 9/1981 | Harris et al. | 252/8.8 |
| 4,422,949 | 12/1983 | Ooms | 252/8.8 |
| 4,476,031 | 10/1984 | Ooms | 252/8.8 |
| 4,659,487 | 4/1987 | May et al. | 252/8.8 |

FOREIGN PATENT DOCUMENTS

| | | |
|---|---|---|
| 0056695 | 7/1982 | European Pat. Off. . |
| 0060003 | 9/1982 | European Pat. Off. . |
| 0085933 | 8/1983 | European Pat. Off. . |
| 2040418 | 1/1971 | France . |
| 3314677 | 10/1984 | Fed. Rep. of Germany . |

*Primary Examiner*—Josephine Barr

*Attorney, Agent, or Firm*—Ernest G. Szoke; Henry E. Millson, Jr.; Real J. Grandmaison

[57] ABSTRACT

Aqueous concentrated fabric softeners having particularly good dispersibility in water containing a quaternary ammonium compound, a condensation product of a natural fat and a hydroxyalkyl polyamine, a fatty amine polyglycol ether, a polyglycol ether, a fatty acid ester, and an acid to provide a pH of 3.5 to 5.

10 Claims, No Drawings

AQUEOUS CONCENTRATED FABRIC SOFTENER

This application is a continuation of application Ser. No. 819,165, filed Jan. 14, 1986, now abandoned.

BACKGROUND OF THE INVENTION

1. Field of the Invention

This invention relates to an aqueous concentrated fabric softner having particularly good dispersibility in water.

2. Description of Related Art

Aqueous fabric softners, which are generally added to the final rinse of the washing cycle in an automatic washing machine for the aftertreatment of freshly washed laundry, contain from about 3 to about 6% of fabric softening agents. These fabric softening agents are generally substantially water-insoluble quaternary ammonium compounds containing 2 long-chain groups in the molecule. The most effective compounds of this type include the widely used ditallow alkyl dimethyl ammonium chlorides. In addition to these fabric softeners having relatively low active substance content, so-called concentrates have also been developed in recent years, having the advantage of containing greater amounts of active substance per unit volume. Softener concentrates of this type contain from about 10 to 15% of fabric softening agents. Highly concentrated fabric softeners can contain as much as about 50% by weight of fabric softening agents. Examples of such highly concentrated aqueous fabric softeners are disclosed in German Patent Application No. 33 14 677.

In use, the concentrates first are diluted with water to standard active substance concentrations of from about 3 to about 6% and then are added to the final rinse. Alternatively, the concentrated fabric softener may be added directly to the final rinse water to yeild the same level of active substance. In either case, the softener concentrates must satisfy stringent requirements in regard to their dispersibility in water. Accordingly, the softener concentrates typically contain emulsifiers, dispersants, viscosity regulators, and/or other auxiliaries, all of various types, to improve their dispersibility in water. In general, these emulsifiers, dispersants and other auxiliaries do not contribute towards the fabric softening properties of the concentrates. Accordingly, attempts have repeatedly been made to produce softener concentrates having a minimum of these non-softening auxiliaries.

DESCRIPTION OF THE INVENTION

It has now surprisingly been found that fabric softeners containing substantially no non-softening auxiliaries have both excellent fabric softening effect and excellent dispersibility in water. This good dispersibility is not only advantageous when the softeners are used in the washing or after-treatment process, it also provides for particularly simple production. Accordingly, the present invention relates to an aqueous concentrated fabric softener containing fabric softening quaternary ammonium compounds and a condensation product of a natural fat and a hydroxyalkyl polyamine. More particularly, the concentrated softener comprises a homogenizate obtained by mixing the following components in molten form:

(a) a quaternary ammonium compound;

(b) a condensation product of a natural fat and a hydroxyalkyl polyamine; and (c) an alkyl or alkenyl maine polyglycol ether dispersant, the alkyl or alkenyl moiety having from 8 to 22 carbon atoms; at elevated temperature with warm water, followed by cooling.

In the context of the invention, the term "concentrated fabric softener" is understood to include those softeners containing from about 10 to 40% by weight of the above described fabric softening components (a) and (b).

Quaternary ammonium compounds suitable for use as component (a) include those containing two long-chain, saturated or unsaturated, aliphatic groups, each group containing from 14 to 26, and preferably from 16 to 20, carbon atoms and at least one quaternary nitrogen atom in the molecule. The long-chain aliphatic groups may be linear or branched and, accordingly, may be derived from fatty acids, fatty amines, Guerbet amines or from the alkylamines obtained by reduction of nitro-paraffins. The aliphatic groups may also contain ester, ether or amide linkages.

Suitable quaternary ammonium compounds may be derived from ammonia, such as by alkylation of long-chain secondary or tertiary amines. Examples of such quaternary compounds include distearyl dimethyl ammonium chloride, ditallowalkyl dimethyl ammonium chloride, ditallowalkyl dimethyl ammonium methosulfate, dioleyl dimethyl ammonium chloride, dioleyl dimethyl ammonium methosulfate, ditallowalkyl methyl hydroxyethyl ammonium chloride, ditallowalkyl methyl hydroxyethyl ammonium methosulfate, ditallowalkyl methyl hydroxypropyl ammonium chloride, ditallowalkyl methyl hydroxypropyl ammonium methosulfate and the adducts of ethylene oxide with the hydroxyalkyl derivatives mentioned above. Other suitable quaternary ammonium compounds include the imidazoline compounds which may be obtained by reaction of 1 mole of an aminoalkyl ethylene diamine or hydroxyalkyl ethylene diamine with 2 moles of a long-chain $C_{14}$–$C_{26}$ fatty acid or an ester thereof and which are subsequently converted by alkylation into the quaternary imidazolinium compounds.

In all these quaternary ammonium compounds, the anion generally comprises the acid radical present in the alkylating agent used for quaternization. Accordingly, the anion may be, for example, chloride, bromide, methyl sulfate, ethyl sulfate, methane, ethane or toluene sulfonate. Favorable results are also obtained when the quaternary ammonium compounds are mixtures of imidazoline derivatives and of ammonia derivatives each containing two $C_{14}$–$C_{26}$ alkyl or alkenyl groups. Other suitable quaternary ammonium compounds include the quaternized esterification products of 1 mole of methyl diethanolamine or methyl dipropanolamine with 2 moles of a $C_8$–$C_{22}$ monocarboxylic acid.

The condensation products suitable for use as component (b) are described for example in U.S. Pat. No. 3,775,316, the disclosures of which are incorporated herein by reference. The condensation products may be obtained by reaction of a natural fat, for example, a fatty acid triglyceride of fatty acids containing from 8 to 24 carbon atoms and of which at least 50% by weight are fatty acids containing 16 or more carbon atoms per fatty acid residue, with a hydroxyalkylpolyamine containing at least one hydroxyethyl, hydroxypropyl or dihydroxypropyl group and at least 2 nitrogen-bound hydrogen atoms. In this reaction, ⅓ mole of the fatty acid triglyceride is reacted for every primary and secondary amino group and for every hydroxyl group present in the hydroxyalkyl polyamine, based on 1 mole of the hydroxyalkylpolyamine. These condensation products comprise one of the active fabric softening components of the fabric softeners of the present invention.

Examples of the above-mentioned hydroxyalkylpolyamines include hydroxyethyl ethylene diamine, dihydroxyethyl ethylene diamine, hydroxyethyl diethylene triamine and hydroxypropyl diethylene triamine.

The fatty acid condensates, hereinafter referred to as "condensates", may also be present in the form of mixtures with various other compounds. Apart from monoamides, diamides and diamide esters, the condensates contain from 10 to 30% by weight of fatty acid partial glycerides (fatty acid mono- and diglycerides). The fatty acid condensates may also contain fatty acid triglycerides, free fatty acids, free amines and glycerine as secondary reaction products.

The $C_8$–$C_{22}$ alkyl or alkenyl amine polyglycol ethers (component c of the fabric softeners of the present invention, which are referred to hereinafter as "fatty amine polyglycol ethers") are compounds of which the fatty alkyl or fatty alkenyl radical contains from 8 to 22 carbon atoms and preferably from 16 to 18 carbon atoms. The compounds contain 1 or 2 polyglycol ether residues derived from ethylene oxide and/or propylene oxide. The number of alkylene oxide groups in the molecule is from about 2 to 50 and, more preferably about 25. Particularly good results are obtained with the adduct of 25 moles of ethylene oxide with 1 mole of stearyl amine.

The fabric softeners according to the invention contain in particular from 10 to 40% by weight of the active agents (a) and (b) the weight ratio of (a) to (b) being in the range from 10:1 to 1:15. To produce softener concentrates containing components (a) and (b) in lower concentrations, the water with which the melt of active components is mixed need only be moderately heated by virtue of the good dispersibility in water of the concentrates of the invention.

In general, the homogenization of products having low active substance concentrations does not require highly effective homogenizers although the use of such machines is generally not harmful and leads particularly quickly to finely divide stable products. These low concentration products require little or no addition to regulate viscosity both immediately after production and even after prolonged storage. Accordingly, preferred low concentration softeners contain a total of from 10 to 18% by weight of components (a) and (b).

To produce equally preferred, though more highly concentrated softeners containing a total of from 20 to 35% by weight of components (a) and (b), it is generally necessary, if finely divided stable products are to be obtained, to heat the water with which the melt of active components is mixed to temperatures of up to about 80° C. and to use dispersers operating with high shearing forces.

In addition, it is advisable to add viscosity regulators (to be discussed hereinafter) to such concentrates to adjust viscosity to within a desired range during production, storage and use. Depending on the method of production used, on the use of viscosity regulators and on the concentration of the active components, the concentrates obtained are thin-flowing, thick-flowing or even pasty concentrates which are readily dispersible in water both during production and during use and have a viscosity which undergoes little or no change during storage. Pourable products are preferably packed in bottles, while pasty or even thick-flowing products are preferably packed in tubes or other dispensers for paste-like products.

The softening effect and dispersibility in water of the products according to the invention may be further improved by adding from 0.5 to 5% by weight of dispersing and softening polyglycol ethers thereto. Suitable polyglycol ethers are derived from ethylene oxide and have a molecular weight in the range from 200 to 2000, preferably in the range from 200 to 1000 and more preferably in the range from 400 to 600.

A further improvement in the softening effect of the fabric softeners of the invention may be obtained by adding certain fatty acid esters. Suitable fatty acid esters include fatty acid glycerine esters of which fatty acid triglycerine esters are particularly preferred. The fatty acid esters are preferably present in the fabric softeners of the present invention in quantities of from 0.05 to 5% by weight.

The products (in undiluted form) of the present invention having a pH of from about 3.5 to 5 have a particularly good viscosity. A pH in this range may be sponstaneously achieved through the use of condensates produced by a variant of the process described in U.S. Pat. No. 3,775,316 using an acid or, alternatively, an acid may be separately added to achieve the desired pH in cases where the condensate contains insufficient or no acids. Suitable acids comprise water-soluble non-surface-active organic acids or inorganic acids. Examples of suitable acids include acetic acid, oxalic acid, glycolic acid, lactic acid, citric acid, tartaric acid, hydrochloric acid, sulfuric acid and phosphoric acid. Mixtures of these acids may also be used. Of the organic acids, glycolic acid is preferred, while of the inorganic acids orthophosphoric acid is preferred for achieving the desired pH.

Particularly desirable properties are exhibited by softener concentrates having compositions lying within the following concentration ranges:

(a) from 2 to 12% by weight of quaternary ammonium compounds,
(b) from 0.3 to 25% by weight of condensation product of a natural fat and a hydroxyalkyl polyamine,
(c) from 0.3 to 1.8% by weight of fatty amine polyglycol ethers,
(d) from 0.5 to 5% by weight of polyglycol ethers,
(e) from 0.1 to 4% by weight of fatty acid esters, and
(f) from 0.01 to 3% by weight of acid.

In addition, the softeners of the invention contain water and other auxiliaries of the type normally used in fabric softeners, such as for example preservatives, viscosity regulators, fragrances and dyes. To prevent discoloration caused by the presence of heavy metal ions in the starting materials, it may be advisable to add small quantities of heavy metal complexing agents.

Suitable preservatives comprise microbicidal compounds. Suitable viscosity regulators comprise water-soluble alkali or alkaline-earth metal salts of mono- or polybasic organic or inorganic acids. Examples of suitable viscosity regulators include sodium chloride, sodium formate, sodium acetate, magnesium chloride, magnesium sulfate and calcium chloride. Of these, particularly preferred viscosity regulators include magnesium chloride and calcium chloride.

The fatty acid ester-containing softener concentrates of the invention may contain the fatty acid esters in substantially the same quantities as the fabric softening quaternary ammonium compounds or in very small amounts in relation to the amount of fabric softening quaternary ammonium compounds. Fabric softeners of the invention having a weight ratio of quaternary ammonium compounds to fatty acid esters in the ranges of from 40:1 to 100:1 and from 2:1 to 1:2 exhibit particularly desirable properties and are therefore preferred.

Particularly preferred softener concentrates contain (a) from 5 to 10% by weight of quaternary ammonium compound, (b) from 1.0 to 6.5% by weight of condensate, (c) from 1.0 to 1.8% by weight of fatty amine polyglycol ether, (d) from 2 to 3% by weight of polyglycol ether, (e) from 0.1 to 0.7% by weight of fatty acid ester, and (f) from 1.0 to 2.0% by weight of acid.

Softeners with particularly well balanced properties may contain (a) a ditallow-alkyl dimethyl ammonium chloride as the quaternary ammonium compound, (b) a condensate of beef tallow and hydroxyethyl ethylene diamine, (c) an adduct of 25 moles of ethylene oxide with 1 mole of stearyl amine, (d) a polyglycol ether having a molecular weight of 400, (e) a stearic acid triglycerine ester, and (f) orthophosphoric acid.

The processes by which the softeners of the invention are produced also affect the properties of the softeners. Accordingly, the invention also relates to methods of making the softeners of the present inention. The processes for producing aqueous concentrated fabric softeners containing fabric softening quaternary ammonium compounds, a fatty acid hydroxyalkyl polyamine condensate and a fatty amine polyglycol ether are characterized in that the quaternary ammonium compound, the condensate and the fatty amine polyglycol ether, optionally together with a polyglycol ether and a fatty acid ester, are mixed with one another at temperatures of from 50° to 70° C. to form a homogeneous melt. The resulting melt is mixed and homogenized at elevated temperature with water heated to temperatures of up to 80° C. using a mixing unit which develops high shearing forces. After homogenization, the mixture is cooled and an acid, a viscosity regulator and other auxilaries commonly used in fabric softeners are optionally added.

The temperature of the melt should be selected so that the melt is just in the form of a homogeneous mixture. This temperature, which may even be slightly above the melting temperature, is at most 80° C. Depending on the concentration and quantitative ratios between the active components in the melt, the water with which the melt is mixed to form a homogeneous dispersion is generally heated to temperatures of up to 80° C.

The concentration and composition of the melt also determine whether it is necessary to use a mixing unit which develops high shearing forces and viscosity regulators for homogenization and for achieving the desired viscosity. The acid is added to the cooled homogenized mixture with a reduction in viscosity generally being observed. The viscosity of the homogenized dispersion may be controlled within certain limits through the type and quantity of acid added. Viscosity may also be regulated by using viscosity regulators. Accordingly, viscosity regulators are used when the viscosity has not been adequately regulated through production or through the type of acid used. A large reduction in viscosity is generally observed after only small additions of viscosity regulator. This is another advantage of the fabric softeners of the present invention, and the processes of making same, since generally little or no viscosity regulator need be used. The quantity of acid may be substantially the equivalent of the quantity of fatty amine polyglycol ether used or, alternatively, slightly more or less acid may also be used. Any deviations from an equivalent quantity should generally be no greater than about 20 mole percent.

Although certain embodiments of the invention have been selected for description in the examples hereinafter, it will be appreciated by those skilled in the art that these examples are merely illustrative of, but do not in any way limit, the scope of the present invention which is defined in the appended claims.

EXAMPLES

The process described in Example 1 is also used in the other Examples 2–9, in which one of the non-essential starting materials is not used, whereby a comparison may be made with Example 1 (which contains a complete set of starting materials). Likewise, the step of incorporating the non-used starting material is not performed in the Examples 2–9.

EXAMPLE 1

10 parts by weight of a ditallow alkyl dimethyl ammonium chloride, 1.5 parts by weight of a condensate (prepared by heating 900 g of hardened beef tallow to 95° C., stirring 114 g of N-hydroxyethyl ethylene diamine into the beef tallow over a period of 35 minutes, stirring for 4 hours at 100° C., cooling to 90° C., adding 42.6 g of 70% glycolic acid and then stirring for another 30 minutes at 90° C.), 1.5 parts by weight of an adduct of 25 moles of ethylene oxide with 1 mole of stearyl amine, 1.0 part by weight of a polyethylene glycol having a molecular weight of 400, 0.15 part by weight of a fatty acid triglyceride (1% by weight $C_{14}$, 29% by weight $C_{16}$ and 70% by weight $C_{18}$ fatty acids) were heated to 65° C. in a heatable mixing vessel. The mixture formed a clear, thinly liquid melt. This melt was stirred into 85 parts by weight of water at 60° C. using an intensive mixer (Ystral-Turbine). After stirring for 10 minutes, the mixture formed a homogeneous paste. After the contents of the vessel had begun to cool, the pH of the paste was adjusted to 4.5 by adding orthophosphoric acid while stirring. When the temperature reached 48° C., 0.2 part by weight of $MgCl_2.6H_2O$ in the form of a 10% by weight aqueous solution was added as a viscosity regulator. The viscosity of the mixture fell spontaneously, to a value of 38 mPas at 20° C. After further cooling to 30° C. (after 60 minutes), small quantities of preservative, dye and fragrance (fragrance scent: fresh/flowery) were added and mixed. After 40 minutes, the temperature of the mixture was 20° C. and its viscosity was 43 mPas. This viscosity showed little change, even after prolonged storage. The product was easily diluted with water.

When fabrics composed of cotton, wool and synthetic fibers, as well as blended fabrics, were treated with this concentrate, after the concentrate had been diluted with water to a concentration of 0.3 g of active agent per liter, the softness of the fabrics was judged to be excellent by a group of 5 experts in the field of assessing fabric softness.

Softener concentrates having the following compositions (Examples 2–4) were prepared and tested in the same way as described in Example 1 and were found to be equally good:

| Starting material | Example No. 2 | 3 | 4 |
|---|---|---|---|
| Ditallow dimethyl ammonium chloride | 10 | 10 | 10 |
| Condensate | 1.0 | 1.0 | 2.0 |
| Stearylamine + 25 moles EO | 1.5 | 1.5 | 1.5 |
| Polyethylene glycol, MW 400 | 2.0 | 1.0 | 1.0 |
| Fatty acid triglyceride | 0.15 | 0.15 | 0.15 |
| Ester of isononanoic acid and hydrogenated $C_{16}$–$C_{18}$ fatty alcohol | — | — | 0.2 |
| Remainder of materials same as in Example 1 | | | |

The fatty acid triglyceride used in Examples 2–4 was the same as was used in Example 1.

Softener concentrates having the following compositions (Examples 5–9) were prepared and tested in the same way as described in Example 1.

| Examples 5 to 9 | | | | | |
|---|---|---|---|---|---|
| | Example No. | | | | |
| Starting material | 5 | 6 | 7 | 8 | 9 |
| Ditallow dimethyl ammonium chloride | 2 | 2 | 2 | 2 | 2 |
| Condensate | 8.5 | 11 | 15 | 21 | 25 |
| Stearylamine + 25 moles EO | 1.8 | 1.8 | 1.8 | 1.8 | 1.8 |
| Polyethylene glycol, MW 400 | 2.0 | 1.0 | 2.0 | 3.5 | 5.0 |
| Fatty acid triglyceride | 1.5 | 0.15 | 0.25 | 0.4 | 0.5 |
| Isononanoic acid ester | — | 0.5 | 0.6 | 0.7 | 1.0 |
| Remainder of materials same as in Example 1 | | | | | |

The product of Example 5 was a free-flowing liquid, the products of Examples 6 and 7 were thickly liquid to pasty and the product of Example 9 was a paste. All the products were readily dispersible in water.

The fatty acid triglyceride and the isononanoic acid ester used in Examples 5–9 were the same as were used in Examples 1 and 4, respectively. When other quaternary ammonium compounds suitable as fabric softeners were used in place of distearyl dimethyl ammonium chloride, comparable results were obtained. Comparable results were also obtained when condensates based on hardened palm oil, peanut oil and mixtures thereof were used in place of the condensate derived from hardened beef tallow.

Softeners of lower concentration containing, for example, only about 3 to about 8% by weight of the quaternary ammonium compounds plus condensate may also be prepared in the same way as described above. Even without the addition of viscosity regulators, these components give readily water-dispersible, thinly liquid products having excellent fabric softening properties.

Although the present invention has been described in terms of a number of specific examples and embodiments thereof, it will be appreciated by those skilled in the art that a wide variety of equivalents may be substituted for the specific components and steps of production described herein, all without departing from the spirit and scope of the present invention, as defined in the appended claims.

What is claimed is:

1. An aqueous concentrated fabric softener consisting essentially of, in percent by weight,
   (a) from about 2 to about 12% of a fabric softening quaternary ammonium compound;
   (b) from about 0.3 to about 25% of a condensation product of a natural fat containing from 8 to 24 carbon atoms wherein at least about 50% by weight is a fatty acid containing 16 or more carbon atoms per fatty acid residue, with a hydroxyalkyl polyamine containing at least one hydroxyethyl, hydroxypropyl or dihydroxypropyl group and at least 2 nitrogen-bound hydrogen atoms;
   (c) from about 0.3 to about 1.8% of an alkyl or alkenyl amine polyglycol ether dispersant wherein the alkyl or alkenyl moiety contains from 8 to 22 carbon atoms, and the polyglycol ether residue contains from about 2 to about 50 moles of alkylene oxide per mole of said amine;
   (d) from about 0.5 to about 5% of a polyglycol ether derived from ethylene oxide and having a molecular weight of from about 200 to about 2000;
   (e) from about 0.1 to about 4% of a fatty acid ester; and
   (f) from about 0.01 to about 3% of an acid to aobtain a pH of the fabric softener in the range of from about 3.5 to about 5;

wherein components (a), (b), and (c) are present in the fabric softener as a homogenizate obtained by mixing a melt of said components, formed at a temperature in the range of about 50° to about 80° C., with water having a temperature in the range of about 50° to about 80° C., followed by cooling.

2. The aqueous concentrated fabric softener of claim 1 wherein the ratio by weight of component (a) to component (e) is from about 40:1 to about 100:1.

3. The aqueous concentrated fabric softener of claim 1 wherein the ratio by weight of component (a) to component (e) is from about 2:1 to about 1:2.

4. The aqueous concentrated fabric softener of claim 1 wherein the quantities of ingredients are as follows:
   (a) from about 5 to about 10%;
   (b) from about 1.0 to about 6.5%;
   (c) from about 1.0 to about 1.8%;
   (d) from about 2 to about 3%;
   (e) from about 0.1 to about 0.7%; and
   (f) from about 0.1 to about 2.0%.

5. The aqueous concentrated fabric softener of claim 1 wherein components (a) through (f) are as follows:
   (a) ditallow alkyl dimethyl ammonium chloride;
   (b) the condensation product of beef tallow with hydroxyethyl ethylene diamine;
   (c) the adduct of 25 moles of ethylene oxide with 1 mole of stearylamine;
   (d) polyglycol ether having a molecular weight of 400;
   (e) stearic acid triglycerine ester; and
   (f) orthophosphoric acid.

6. The aqueous concentrated fabric softener of claim 4 wherein components (a) through (f) are as follows:
   (a) ditallow alkyl dimethyl ammonium chloride;
   (b) the condensation product of beef tallow with hydroxyethyl ethylene diamine;
   (c) the adduct of 25 moles of ethylene oxide with 1 mole of stearylamine;
   (d) polyglycol ether having a molecular weight of 400;
   (e) stearic acid triglycerine ester; and
   (f) orthophosphoric acid.

7. The aqueous concentrated fabric softener of claim 1 wherein said component (a) comprises a quaternary ammonium compound containing two long-chain, saturated or unsaturated, aliphatic groups, each of said groups containing from 14 to 26 carbon atoms and at least one quaternary nitrogen atom in the molecule.

8. The aqueous concentrated fabric softener of claim 1 wherein said hydroxyalkyl polyamine is selected from the group consisting of hydroxyethyl ethylene diamine, dihydroxyethyl ethylene diamine, hydroxyethyl diethylene triamine, and hydroxypropyl diethylene triamine.

9. The aqueous concentrated fabric softener of claim 1 wherein said component (e) comprises a fatty acid glycerine ester.

10. The aqueous concentrated fabric softener of claim 1 wherein said component (c) comprises the adduct of 25 moles of ethylene oxide with 1 mole of stearyl amine.

* * * * *